US006864865B2

(12) United States Patent
Maeda

(10) Patent No.: US 6,864,865 B2
(45) Date of Patent: Mar. 8, 2005

(54) DISPLAY UNIT, DISPLAY DEVICE, AND METHOD FOR MANUFACTURING THE DISPLAY DEVICE

(75) Inventor: Shuichi Maeda, Yokohama (JP)

(73) Assignee: OJI Paper Co., Ltd., Tokyo (JP)

( * ) Notice: Subject to any disclaimer, the term of this patent is extended or adjusted under 35 U.S.C. 154(b) by 393 days.

(21) Appl. No.: 10/000,724

(22) Filed: Oct. 31, 2001

(65) Prior Publication Data

US 2002/0050784 A1 May 2, 2002

(30) Foreign Application Priority Data

Nov. 1, 2000 (JP) ..... 2000-334193

(51) Int. Cl.[7] ..... G09G 03/20
(52) U.S. Cl. ..... 345/55
(58) Field of Search ..... 345/55, 107, 48, 345/84, 182, 173, 158; 313/582–586, 113; 359/495–500; 204/606; 40/660

(56) References Cited

U.S. PATENT DOCUMENTS

| | | | | | |
|---|---|---|---|---|---|
| 4,126,854 | A | | 11/1978 | Sheridon | |
| 4,143,103 | A | | 3/1979 | Sheridon | |
| 5,538,455 | A | * | 7/1996 | James, II | 446/236 |
| 5,604,027 | A | * | 2/1997 | Sheridon | 428/323 |
| 5,922,268 | A | | 7/1999 | Sheridon | |
| 5,961,804 | A | * | 10/1999 | Jacobson et al. | 204/606 |
| 5,984,747 | A | * | 11/1999 | Bhagavatula et al. | 445/24 |
| 6,009,653 | A | * | 1/2000 | Harrington | 40/660 |
| 6,055,091 | A | | 4/2000 | Sheridon et al. | |
| 6,111,696 | A | * | 8/2000 | Allen et al. | 359/495 |
| 6,262,833 | B1 | * | 7/2001 | Loxley et al. | 359/296 |
| 6,407,763 | B1 | * | 6/2002 | Yamaguchi et al. | 347/112 |
| 6,452,332 | B1 | * | 9/2002 | Moore | 313/582 |
| 6,459,200 | B1 | * | 10/2002 | Moore | 313/582 |
| 6,473,072 | B1 | * | 10/2002 | Comiskey et al. | 345/173 |
| 6,515,649 | B1 | * | 2/2003 | Albert et al. | 345/107 |

FOREIGN PATENT DOCUMENTS

| | | |
|---|---|---|
| DE | 40 08 825 | 3/1991 |
| EP | 0 913 803 | 5/1999 |
| JP | 56-123577 | 9/1981 |
| JP | 01-282589 | 11/1989 |
| JP | 2000-089260 | 3/2000 |

OTHER PUBLICATIONS

Communication from Eurpoean Patent Office regarding counterpart application.

Date–stamped letter from foreign associate enclosing European Search Report.

* cited by examiner

*Primary Examiner*—Vijay Shankar
*Assistant Examiner*—Prabodh M. Dharia
(74) *Attorney, Agent, or Firm*—Harness, Dickey & Pierce, PLC

(57) ABSTRACT

A display unit includes a transparent hollow tube member and at least one display element sealed in the transparent hollow tube member. The display element is capable of rotating independently in the hollow tube member. Also, the display element has a surface which is divided into a plurality of areas having different colors and is polarized to have at least two poles having a different electrification state. An image formed by a display device including the display units is kind to the eye in the same way as printed matter, and does not cause eyestrain due to flickering of emitted light.

15 Claims, 8 Drawing Sheets

DISPLAY UNIT, DISPLAY DEVICE, AND METHOD FOR MANUFACTURING THE DISPLAY DEVICE

CROSS-REFERENCE TO RELATED APPLICATIONS

This application claims priority from Japanese Patent Application No. 2000-334193, filed Nov. 1, 2000, which is hereby incorporated by reference.

BACKGROUND OF THE INVENTION

1. Field of the Invention

The present invention relates to a display device, a display unit, and to a method for producing the display device and the display unit. More specifically, the present invention relates to a display device which may be used as a display of a personal computer, a mobile phone, a mobile terminal, etc., or which may be used as an independent portable display, such as a digital (or electronic) paper or a digital book that obtains information from such appliances, to a display unit which form such a display device, and to a method for producing such display device and display unit.

2. Description of Related Art

Display devices such as that shown in FIGS. 9A and 9B are conventionally known as disclosed in U.S. Pat. Nos. 4,126,854, 4,143,103, and Japanese Unexamined Patent Application, First Publication, No. Hei 1-282589. In the display device shown in FIGS. 9A and 9B, particles are used as the display medium, each of which has a hemisphere portion having a color different from the color of the other hemisphere portion. That is, a dispersed particle rotation type panel display 5 includes a capsule structure formed in a transparent substrate 2 of a plate shape in which a rotary particle 1 for display having hemispheres 1*a* and 1*b* of different colors is encapsulated and held in a space 3 of spherical shape which is filled with a dielectric liquid 4. A transparent electrode 8 including an electrode 6 and a transparent panel 7 is closely attached to the front and the back of the transparent substrate 2 and an electric field is applied by means of a power source 9 so that an image is formed by the rotation of the particles 1.

Also, a device similar to the one described above having particles of cylindrical shape is disclosed in Japanese Unexamined Patent Application, First Publication, No. 2000-89260.

In general, an electric double layer is formed around a particle which is present in a liquid due to transfer of electric charge between the particle and the liquid. As a result, the particle is electrified positively or negatively. A rotatable particle for display is formed so as to have at least two areas of different colors and different electrification characteristics in a liquid. When an electric field is applied to such a particle, one of the areas of the particle is aligned in one direction due to a torque which acts to align the pole axis of the particle with the direction of the electric field. If the direction of the electric field is reversed, the particle is turned around and the color of the particle visible from a viewpoint is changed.

Since the above-mentioned display device is of a light reflecting type device, an image formed by the display device is kind to the eye in the same way as printed matter, and does not cause eyestrain due to flickering of emitted light.

The display device may be formed by using the following method. First, the above-mentioned rotatable particles for display are mixed with an elastomer, and the mixture is thermally cured after being formed into a sheet shape. The mixture is then immersed in a dielectric liquid, such as an organic solvent or an oil. The liquid acts as a plasticizer and causes a swelling of the elastomer. Since the elastomer swells nearly uniformly, a space is generated around each particle, and at the same time, the space is filled with the liquid. As a result, the particle is held in the space surrounded by the liquid. Accordingly, the particle may freely rotate in the space. As shown in FIGS. 9A and 9B, an elastomer sheet in which particles, each of which have hemispheres of two different colors, are encapsulated in the space 3 of spherical shape filled with the dielectric liquid 4, may be obtained. The transparent electrodes are disposed so as to sandwich the elastomer sheet. The transparent electrodes may be formed by using a transparent conductive membrane made of, for instance, an indium-tin oxide (ITO).

However, there are many problems associated with the above-mentioned manufacturing method and the display device produced by using the method. That is, in the above-mentioned manufacturing method, the process is complicated due to the necessity of, for instance, the thermal curing step after the formation of the elastomer sheet or the immersion step using the dielectric liquid. Also, since the space 3 is formed by the swelling of the elastomer, the type of the liquid which can be used in the process is limited. Moreover, since the degree of the swelling of the elastomer depends on the temperature, it is difficult to obtain spaces 3 of uniform size and excellent shape, i.e., spaces 3 of spherical shape having a constant diameter. If the sizes of the spaces 3 are not uniform and the shapes thereof are irregular, a desired image cannot be produced with good reproducibility. That is, if the space 3 is too small for the rotatable particle 1, or the shape of the space 3 is distorted, the rotation of the particle in the space 3 is inhibited, and the degree of rotation of the rotary particle 1 necessary for displaying an image (180° in general) cannot be obtained when the rotary particle 1 rotates in accordance with an electric anisotropy under the influence of the applied external electric field. On the other hand, if the size of the space 3 is too large for the rotary particle 1, the ratio of the liquid portion, which does not take part in image display, to the particle portion becomes relatively too large, and it is difficult to obtain an image having an excellent contrast.

SUMMARY OF THE INVENTION

Accordingly, an object of the invention is to provide a display unit, a display device, and a display method in which the above-mentioned problems in the production process and quality of the display are solved, and the images formed are kind to the eye in a manner similar to that of printed matter and does not cause eyestrain due to flicking of emitted light.

The above object may be achieved by a display unit, including a transparent hollow tube member; and at least one display element sealed in the transparent hollow tube member, the display element being capable of rotating independently, wherein the display element has a surface which is divided into a plurality of areas having different colors, and the display element is polarized to have at least two poles having a different electrification state.

In accordance with another aspect of the invention, the shape of the display element is selected from the group consisting of a sphere, oval, and cylinder.

In yet another aspect of the invention, the display unit further includes a liquid which is sealed in the hollow tube member, the liquid being present between the display element and the hollow tube member.

In yet another aspect of the invention, a plurality of the display units is arranged over substantially the entire display region of the display device.

In yet another aspect of the invention, substantially all of the plurality of display units are arranged so as to be substantially parallel to each other.

In yet another aspect of the invention, the display device further includes an electric field application device which applies an electric field to the display unit.

The present invention also provides a method for displaying colors on a display by using the above-mentioned display device, including the step of: applying an electric field corresponding to an image signal to the display element.

The present invention also provides a method for producing a display device including at least one display unit, comprising the steps of: forming a hollow tube member; introducing a liquid in which display elements have been dispersed into the hollow tube member; sealing an end portion of the hollow tube member to form a display unit comprising the hollow tube member in which the display element is contained; and arranging the display unit over a display region of the display device.

In accordance with another aspect of the invention, the specific gravity of the liquid is close to the specific gravity of the display element.

In yet another aspect of the invention, the liquid is of a two-liquid system formed by combining a first liquid having higher specific gravity than that of the display element and a second liquid having lower specific gravity than that of the display element.

In yet another aspect of the invention, the hollow tube member is formed by a method comprising the steps of: forming a fiber having a two-layer structure; and removing an inner layer of the fiber to produce the hollow tube member.

In yet another aspect of the invention, the inner layer of the fiber is made of a material which may be dissolved in a solvent.

The present invention also provides a method for producing a display device including at least one display unit, comprising the steps of: forming a fiber having a three-layer structure, an intermediate layer of the fiber being formed by a material to be dissolved; dissolving the intermediate layer of the fiber; sealing an end portion of the fiber to form a display unit comprising the innermost layer of the fiber freely rotatable in the outermost layer of the fiber; and arranging the display unit over a display region of the display device, wherein the innermost layer of the fiber functions as a display element and the outermost layer of the fiber functions as a hollow tube member.

In yet another aspect of the invention, the intermediate layer is dissolved by a solvent or by an irradiation of light.

In yet another aspect of the invention, the specific gravity of the intermediate layer, after being dissolved, is substantially the same as the specific gravity of the display element.

In yet another aspect of the invention, the display element of the display unit is cut by using a laser beam, a rotary knife, or a straight knife.

According to embodiments of the present invention, since each display unit is independent to each other, it may be produced by using a simple manufacturing method, such as a coating method. For example, a display device may be produced by dispersing display units in a liquid and applying it onto a sheet shape supporting medium, or by spreading it onto a mesh type supporting medium and then removing the liquid so that the display units are entangled to be a sheet shape. If the display units are arranged in a certain direction when produced, it becomes possible to arrange the display units in parallel, or if they are laminated in an orthogonal direction (i.e., a vertical direction), it is possible to form a display region in a lattice form. Also, since display elements or a liquid is sealed in the display unit, the type of the liquid to be sealed in the display unit may be arbitrary selected. Moreover, if a method such as a melt spinning method is adapted for producing a hollow tube member of the display unit, it becomes possible to produce the hollow tube member with high accuracy as compared with a case where a spherical space is formed by swelling of an elastomer. According to the present invention, as mentioned above, the rotation of the display element is not interfered and it becomes possible to form an excellent image. Further, as shown in FIG. 2, the display element in the display unit may be shown larger than its actual size due to a so-called "convex lens effect" of the side surface (i.e., the circumferential surface) of the hollow tube member containing a transparent liquid. Therefore, the apparent surface area of the display element with respect to the entire display region is shown larger than its actual area, and as a result, an excellent contrast may be obtained.

BRIEF DESCRIPTION OF THE DRAWINGS

Some of the features and advantages of the invention have been described, and others will become apparent from the detailed description which follows and from the accompanying drawings, in which.

DETAILED DESCRIPTION OF THE INVENTION

The invention summarized above and defined by the enumerated claims may be better understood by referring to the following detailed description, which should be read with reference to the accompanying drawings. This detailed description of particular preferred embodiments, set out below to enable one to build and use particular implementations of the invention, is not intended to limit the enumerated claims, but to serve as particular examples thereof.

Display Element

According to an embodiment of the present invention, display elements placed in hollow tube members are independently rotated by an external driving force to form an image.

As a source of the external force, an electric field is most typical but other sources, such as magnetic field, light, heat, and so forth may also be utilized.

Figure 1B:
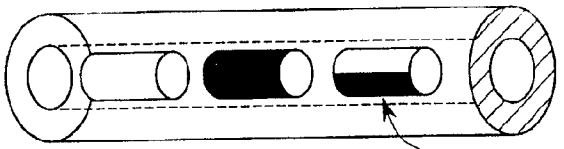
FIG. 1B is a diagram showing the relationship between the display unit and the display elements in an enlarged scale.
Figure 1A:
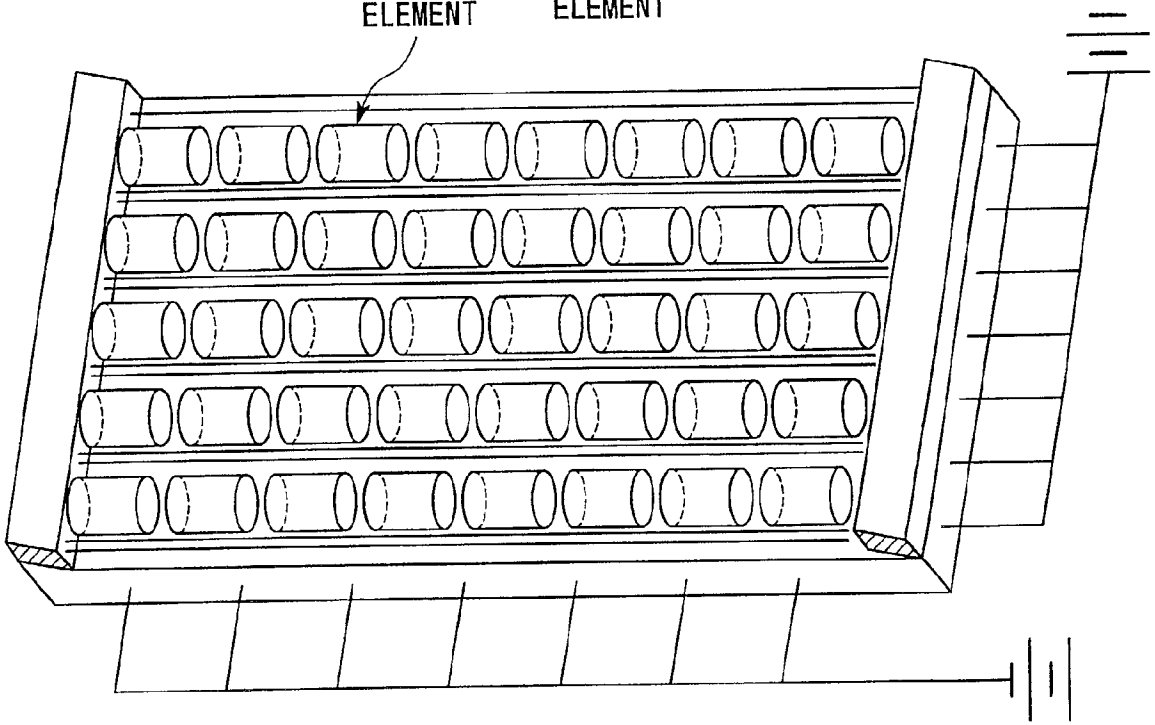
FIG. 1A is a schematic diagram showing a display device according to an embodiment of the present invention in which display units are formed into a sheet shape, and power sources and wires for applying an electric field to the display elements are provided with the display device.
Figure 2:
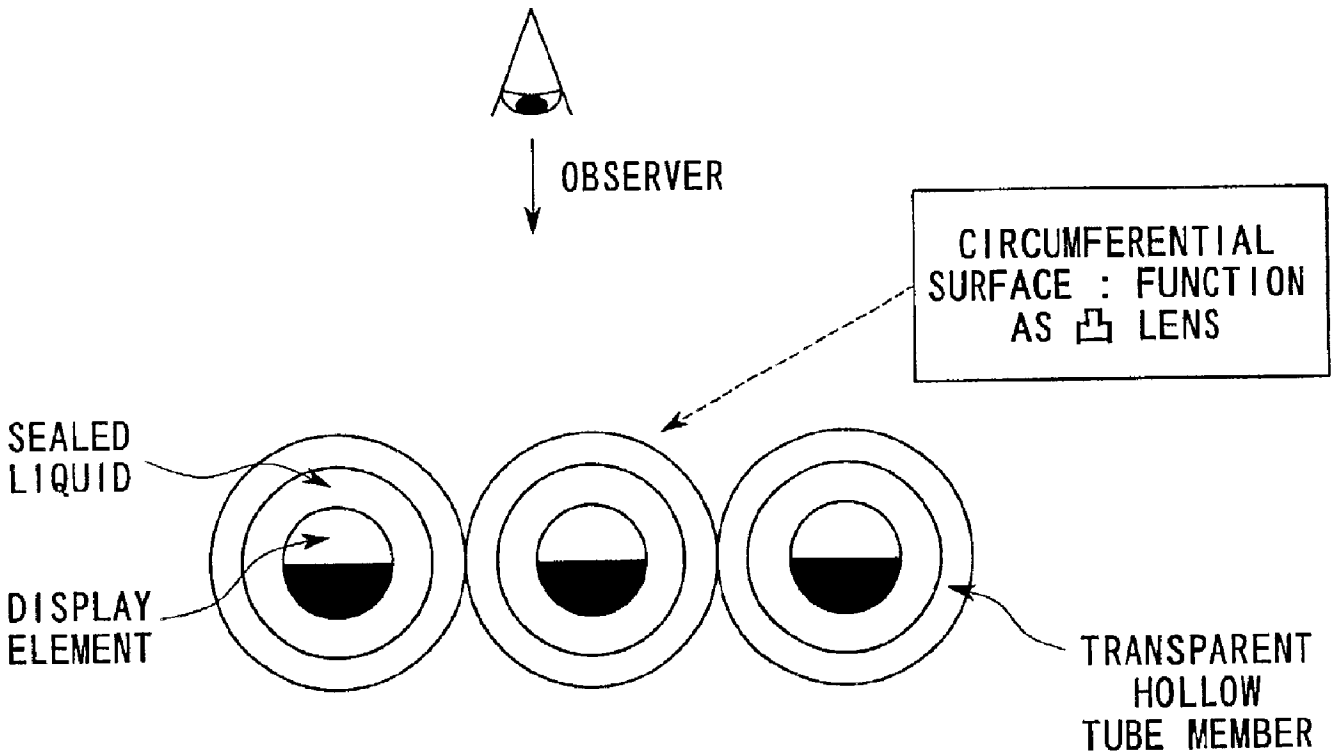
FIG. 2 is a schematic diagram showing display units according to an embodiment of the present invention.

As shown in FIGS. 1A and 1B, the display element according to an embodiment of the present invention has a cylindrical shape, and the side surface (i.e., the circumferential surface) thereof is divided into at least two areas having different colors. For example, a half of the side surface of the display element may be white and the other half may be black. Alternatively, the side surface of the display element may be divided into three areas of, for example, red, blue, and yellow, or may be divided into four areas of red, blue, yellow, and black. In any case, the part of the display element which is visible from the surface of the display device, which contains a plurality of the arranged display elements, forms a color dot, and a letter or an image is formed by a plurality of the dots so arranged.

Examples of a method for partitioning the electrification state of the display element include a formation of an electret fiber, an injection of an ionic material into a resin, an injection of a magnetic element into a resin, and a coating or a vapor deposition of a foreign material onto a single material. The partitioning of electrification state of the display element includes not only the combination of positive and negative electric states but also the combination of strongly positive and weakly positive, strongly negative and weakly negative, and so forth. Moreover, the concept of the partitioning of electrification state includes the combination of the S pole and the N pole in the magnetic field. In addition, the color of the surfaces of the display element may be differentiated by using the color of the material used, by mixing, coating, or vapor depositing a coloring element, or painting the surface of the display element.

The shape of the display element is not limited to the cylindrical shape, and it may be a square rod, a hexagonal rod, and so forth. Also, it is possible to form the display element into a spherical shape or an oval shape. In any case, the shape of the display element is not limited as long as the display element is capable of independently rotating in a hollow tube member. Furthermore, even for the case in which the display element is in a spherical shape or in an oval shape, the display element has at least two areas of different colors.

As an example, a case in which an electric field is used as a driving force for a cylindrical display element will be explained. Since the display element is designed so that the electrification state thereof differs in a half of the circumferential portion with respect to the other half, each display element changes its direction when an electric field is externally applied to the display device based on an image signal, in accordance with the direction of the electric field due to the force of the electric field on the surface charge of the display element. Among a plurality of colors on the circumferential surface of the display element, one which corresponds to the image signal becomes visible from an external point of view through the transparent tube member. Once the display element changes its direction and the position thereof is fixed for a certain period, the fixed state, or the display state, of the display element is maintained even if the application of the electric field is stopped, due to the static friction which acts between the outer surface of the display element and the inner surface of the tube member, or between the outer surface of the display element and a liquid contained in the space.

Hollow Tube Member and Display Unit

According to an embodiment of the present invention, the hollow tube member and a display unit may be produced in accordance with the following procedures:

(1) a polymeric fiber having a two-layer structure of substantially concentric circles is formed by using, for instance, a melt spinning method, and the polymeric fiber is stretched to obtain a fiber having an external diameter of about 20–200 $\mu$m. The resin used for forming the inner layer of the fiber is a resin which may be dissolved in water or an organic solvent after the formation of the fiber. By removing the inner layer using water or an organic solvent, a hollow fiber may be obtained. Alternately, if a fluid (e.g., a gas, a liquid, etc.) is introduced beforehand instead of the soluble resin forming the inner layer, it becomes unnecessary to remove the resin afterwards, and hence, the hollow fiber may be produced in an easier and simpler manner. It is preferable to use a gas, such as nitrogen gas or air, as the fluid introduced. Then, a liquid in which display elements have been dispersed is introduced into the above-mentioned transparent hollow fiber. More specifically, a plurality of the hollow fibers in a bundle is placed in a chamber and the chamber is vacuumed. Then, the liquid in which the display elements are dispersed is introduced into the chamber so that the liquid is drawn into and fills the inside of the hollow fiber. After that, an end portion of the fiber is plugged or sealed while being cut to an appropriate length to form a display unit including a hollow tube member in which display elements are contained.

It is preferable to use a liquid whose specific gravity is close to that of the display element as the liquid for dispersing (or suspending) the display element. If the specific gravity of the liquid is too high, the display element strongly contacts the hollow tube member due to the buoyancy of the display element. If the specific gravity of the liquid is too low, the display element also strongly contacts the hollow tube member due to gravity acting on the display member. In both cases, since the display element strongly contacts the hollow tube member, there is a danger that the rotary motion of the display element will be inhibited when an electric field is impressed on the display element. If an appropriate liquid is not available, it is possible to employ a two-liquid system formed by combining a liquid having higher specific gravity than the display element and a liquid having lower specific gravity than the display element.

A polymeric fiber having a three-layer structure of substantially concentric circles is formed by using, for instance, a melt spinning method, and the polymeric fiber is stretched to obtain a fiber having an external diameter of about 20–200 $\mu$m. The innermost layer is formed by a fiber which forms a display element, and the outermost layer forms a hollow tube member. The intermediate layer is formed by a material which may be dissolved by a solvent. The fiber obtained in this manner is cut from the outermost layer to the innermost layer, and is then immersed in a solvent which dissolves only the intermediate layer among the three layers. After this, both ends of the fiber are sealed to form a display unit having a space between a display element and a tube member so that the display element of cylindrical shape may freely rotate in the tube member. It is possible to cut only the innermost layer to produce a plurality of display elements in the hollow tube member. Also, for the same reasons mentioned above, it is preferable that the specific gravity of the solvent, after the intermediate layer has been dissolved in it, be substantially the same as the specific gravity of the display element.

A polymeric fiber having a two-layer structure of substantially concentric circles is formed by using, for instance, a melt spinning method, and the polymeric fiber is stretched to obtain a fiber having an external diameter of about 20–200 μm. The inner layer is formed by a fiber which forms a display element, and the outer layer forms a hollow tube member. During the melt spinning process, a releasing material, such as silicone oil, is placed between the inner layer and the outer layer. It is preferable that the specific gravity of the silicone oil be also similar to the specific gravity of the display element.

A polymeric fiber having a three-layer structure of substantially concentric circles is formed by using, for instance, a melt spinning method, and the polymeric fiber is stretched to obtain a fiber having an external diameter of about 20–200 μm. The innermost layer is formed by a fiber which forms a display element, and the outermost layer forms a hollow tube member. The intermediate layer is formed by a material which may be dissolved by light. The fiber obtained is cut from the outermost layer to the innermost layer, and then both ends of the fiber are sealed. After that, when light is irradiated onto the fiber, the intermediate layer is dissolved by light which passes through the transparent tube member, to form a display unit in which the display element of cylindrical shape may freely rotate in the tube member. It is possible to cut only the innermost layer to produce a plurality of display elements in the hollow tube member. Also, for the same reasons mentioned above, it is preferable that the specific gravity of a liquid which is produced by dissolving the intermediate layer by light be substantially the same as the specific gravity of the display element.

In each of the above-mentioned methods, it is possible to cut the display element or the display unit by using a laser beam, a rotary knife, or a straight knife. When only the innermost layer of the fiber is cut by using a laser beam from the outside of the tube member, it is necessary to adjust the wavelength, etc., of the laser beam by taking into account the material used for each layer. As for the length of the display element and the hollow tube member to be cut, it is preferable to be between about 5 and 100 μm for the display element, and between about 5 μm and the width of the display device for the hollow tube member. The length of the hollow tube member is more preferably between about 1 mm and the width of the display device.

Display Device

According to an embodiment of the present invention, a display device may be produced by, for example, applying a liquid in which the above-mentioned display unit is dispersed onto a thin supporting medium, and forming the medium into a sheet shape. Alternatively, the above dispersion liquid containing the display unit may be spread onto a supporting medium of mesh shape, and the fluid portion of the dispersion liquid may be removed to form a sheet having a plurality of display units in an entangled manner.

By placing a device which is capable of applying, for instance, an electric field or a magnetic field onto portions of the above-mentioned sheet containing the display units, it becomes possible to write, delete, and rewrite information by means of the display device. Any known device which can apply an electric field or a magnetic field may be employed. When a pair of electrode plates is provided with the above display unit, a glass is generally used for the upper electrode plate. However, it is possible to use a transparent plastic made of, for instance, a polycarbonate resin, an acrylic resin such as polymethy methacrylate, or a styrene resin such as styrene-acrylonitrile copolymer, and so forth for the upper electrode plate. It is preferable that the wire of the electrode plate be vapor deposited with ITO. On the other hand, since the lower side electrode plate need not be transparent, it may be made of a material which is not transparent.

Figure 3B:
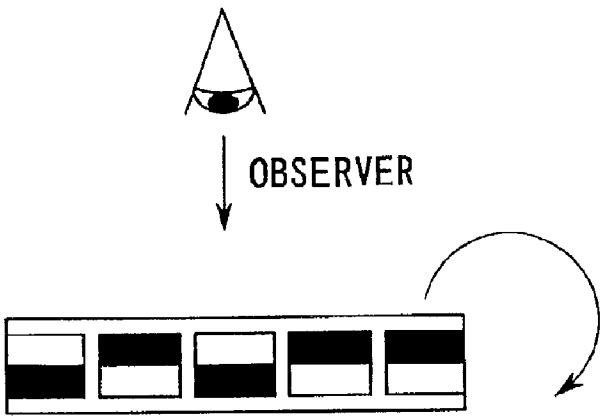
FIG. 3B is a schematic diagram showing a state of the image display after the display device is actuated.
Figure 3A:
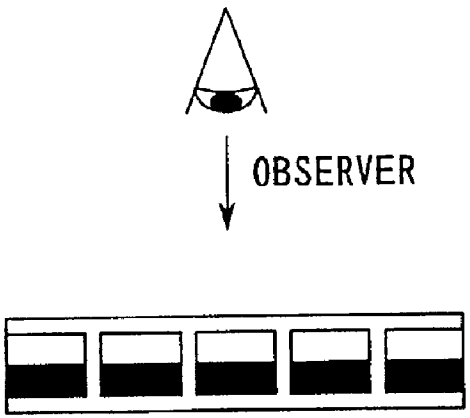
FIG. 3A is a schematic diagram showing a state of an image display before the display device is actuated.

In the following an embodiment of the present invention will be described with reference to the accompanying drawings. FIGS. 3A and 3B are diagrams showing schematic cross-sectional views of a display unit according to an embodiment of the present invention. FIG. 3A shows a state of image display before the display device is actuated, and FIG. 3B shows a state of image display after the display device is actuated.

Figure 4:
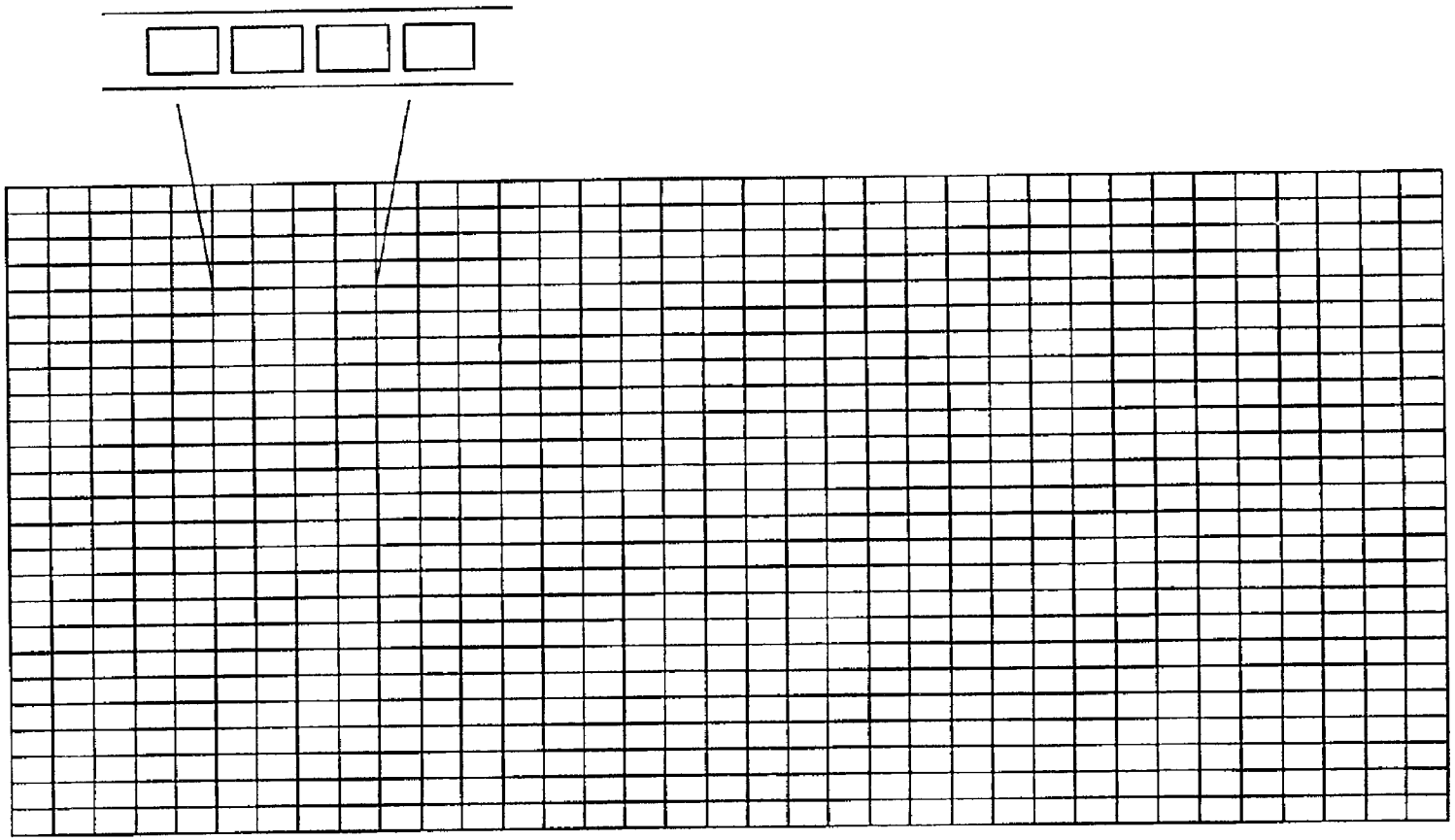
FIG. 4 is a diagram showing a state of an image display viewed from the top before the display device is actuated.
Figure 5:
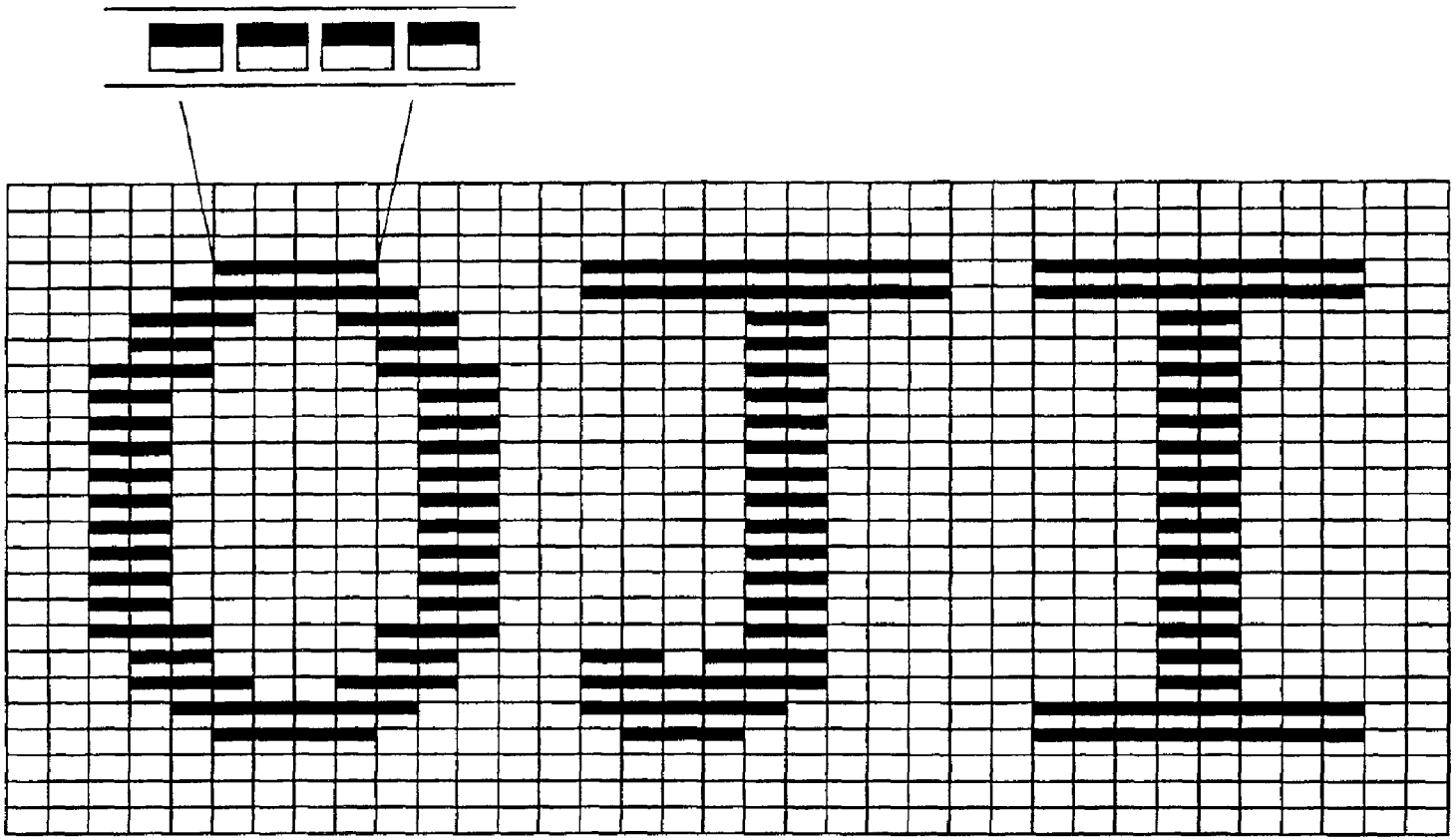
FIG. 5 is a diagram showing a state of the image display viewed from the top during the actuation of the display device, i.e., when information is being written.
Figure 6:
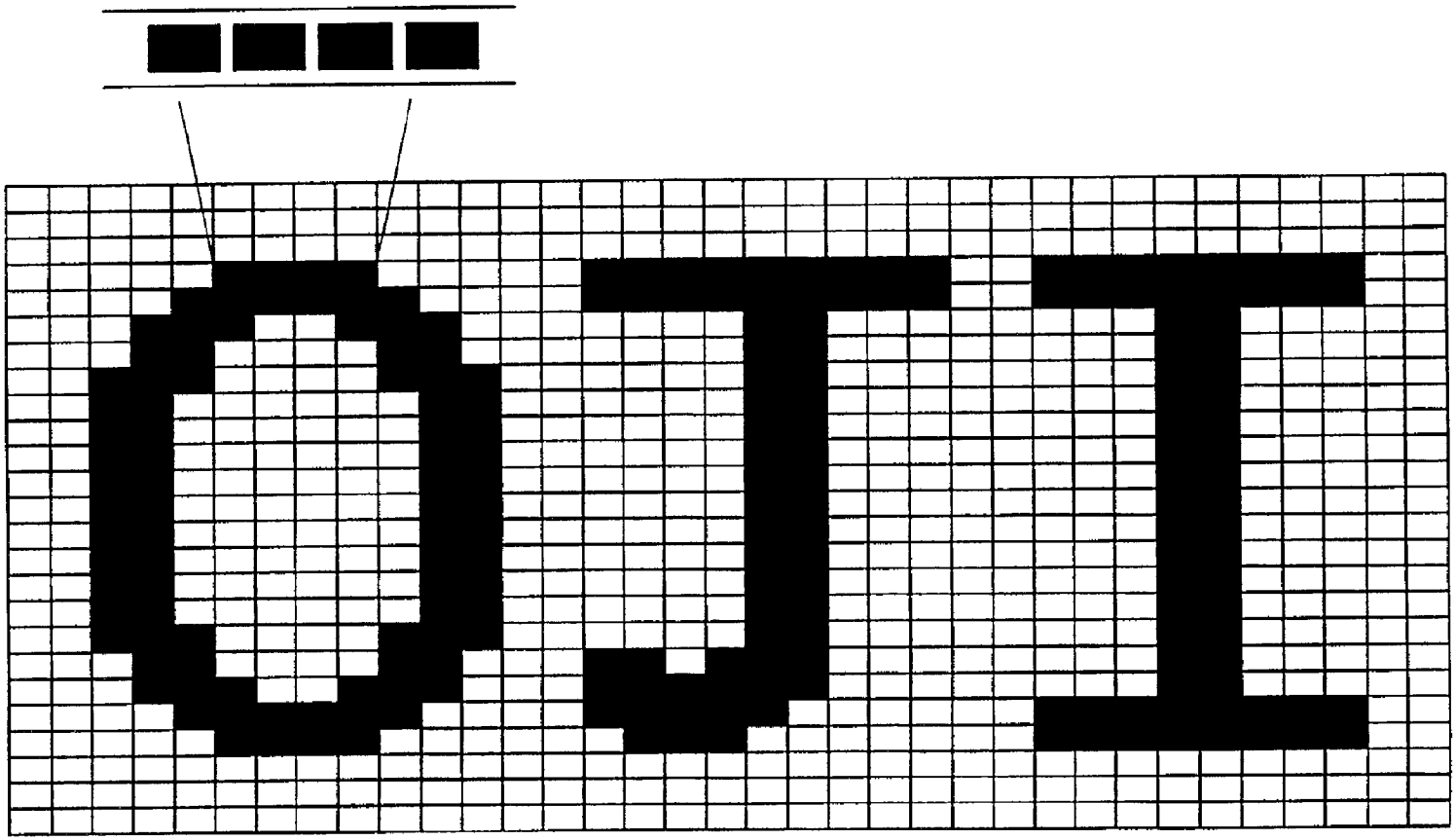
FIG. 6 is a diagram showing a state of the image display viewed from the top after the display device is actuated, i.e., when writing of the information is completed.

FIGS. 4 through 6 are diagrams showing the display device according to the embodiment of the present invention viewed from the top. FIG. 4 shows a state of image display before the display device is actuated. FIG. 5 shows a state of image display during the actuation of the display device, i.e., when information is being written. FIG. 6 shows a state of image display after the display device is actuated, i.e., when writing of the information is completed. In FIGS. 4 through 6, although the length of the display unit is equal to the width of a image display portion and the display units are arranged in parallel, the length of the display unit may be shorter than the width of the image display portion and the display units may be arranged in different form such as in a tangled state.

FIGS. 1A and 1B are diagrams showing another embodiment of the display device according to the present invention in which a display unit is formed into a sheet shape and power sources and wires for applying an electric field to display elements are provided with the display device. Note that although transparent display unit outer tubes are not shown accurately in FIG. 1A, the relationship between the display unit and display elements is shown in FIG. 1B magnified. Also, although electrode plates are not shown in the figures, the display unit is actually sandwiched by the electrode plates in the up-and-down direction and at least the upper electrode is transparent. In this display device, an angular moment or torque caused by Coulomb force is generated for certain display elements by an electric field generated between the two electrode plates so that arbitrary circumferential surfaces of the display elements may be placed in a visible position. The number of display elements which correspond to the electric field is not limited and may be only one or two or more of the display elements may be operated at a time.

Next, embodiments of the present invention will be described as follows, however, it is understood that the present invention is not by any means intended to be limited to those embodiments.

Embodiment 1

Figure 7:
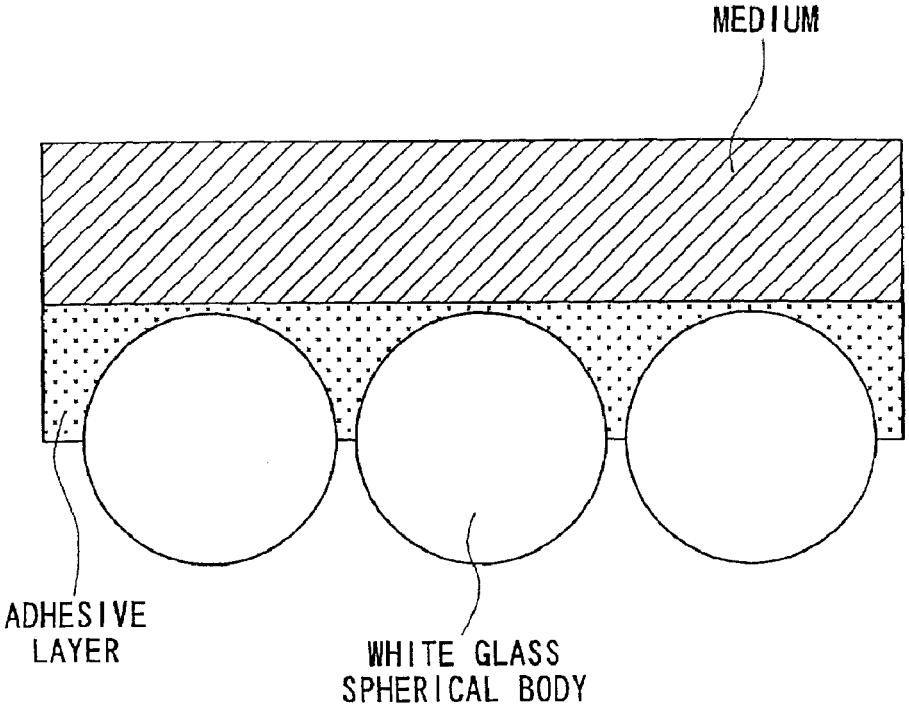
FIG. 7 is a schematic diagram for explaining a production of spherical display elements.

First, spherical display elements were prepared by using a method disclosed in Japanese Unexamined Patent Application, First Publication, No. Sho 56-123577. That is, as shown in FIG. 7, a heat resistant acrylic adhesive layer having a thickness of about 35 μm was formed on a surface of a medium made of a polyester film having a width of about 10 cm. Then, a plurality of white glass sphere bodies having a diameter of about 50 μm were arranged on the above-mentioned adhesive layer to form a monolayer thereof. That is, after a sufficient number of the white glass sphere bodies were applied onto the adhesive layer of the medium, the sphere bodies were compressed onto the adhesive layer so that the half of each of the sphere bodies is embedded in the adhesive layer, by using a silicone rubber roller via a sheet made of polytetrafluoroethylene. After this, a high pressure gas is blown onto the adhesive layer to remove the sphere bodies which were raised from the surface to arrange a monolayer of the sphere bodies on the medium. During the process, the thickness of the adhesive layer was set to be about 25 $\mu$m so that almost the half of the sphere bodies may be embedded in the adhesive layer.

Then, by using a vapor deposition device, the film including the embedded sphere bodies, i.e., the medium, was placed so that the surface of the medium onto which the sphere bodies had been embedded faces the vapor deposition source of the vapor deposition device. After this, $Sb_2S_3$ which was used as a coloring agent (black) and subsequently $MgF_2$ which was used as a surface charge controlling agent were deposited onto the surface of the medium not having the embedded sphere bodies.

After this, the medium was immersed in ethanol to dissolve the adhesive layer and the sphere bodies were removed from the adhesive layer by using a brush. The hemisphere of the sphere bodies which had been embedded in the adhesive layer was not colored and the other hemisphere of the sphere bodies was colored black. By this method, a number of desired spherical display elements were obtained.

Figure 8:
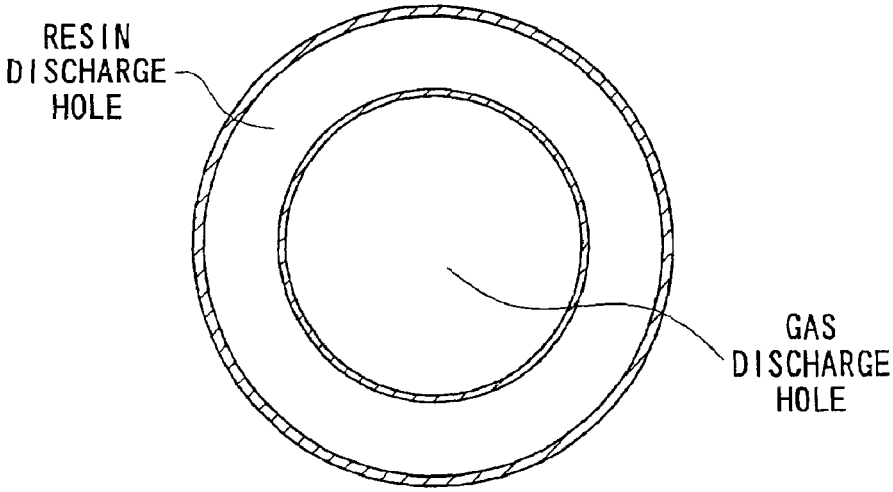
FIG. 8 is a schematic diagram showing a mouthpiece of an extruder which may be used for a production of hollow tube member according to an embodiment of the present invention.
Figure 9A:
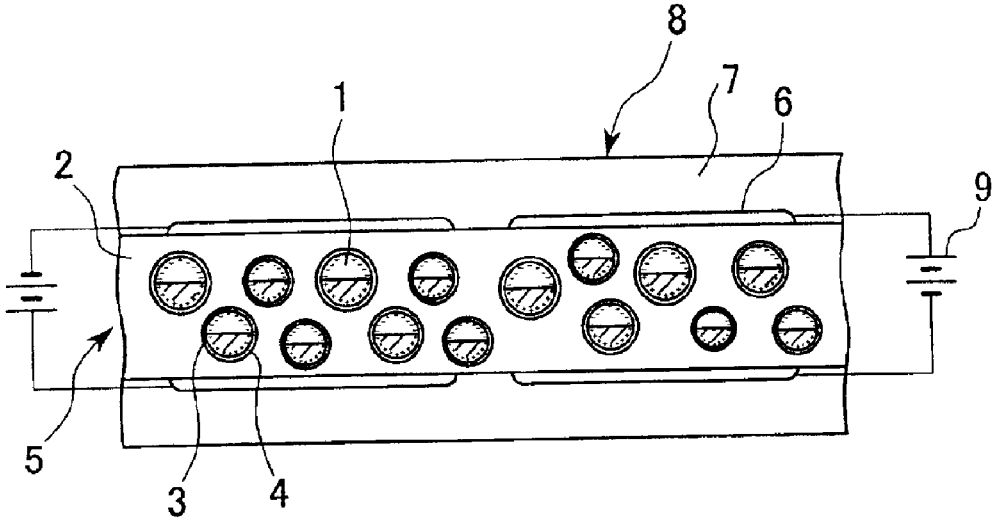
FIGS. 9A and 9B are diagrams showing a conventional display device including display elements.
Figure 9B:
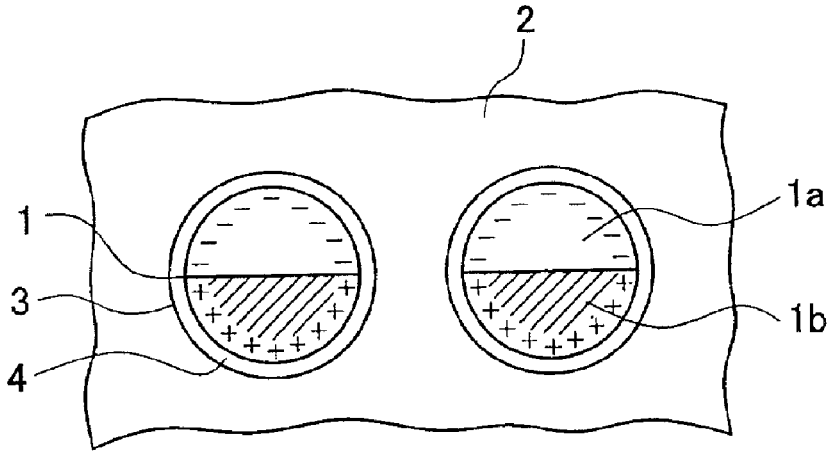

A hollow tube member was prepared as follows. While a nitrogen gas was discharged from a central hole of a mouthpiece, which is schematically shown in FIG. 8, of an extruder, ethylene-vinyl acetate copolymer having a 25% copolymer ratio of vinyl acetate was extruded from a discharge hole surrounding the central hole. The temperature of the extruder was set to be 230° C. and the pressure of the nitrogen gas was maintained substantially at atmospheric pressure. The extruding rate of melted ethylene-vinyl acetate was 0.15 kg/hr. The melted fiber discharged from the hole of the extruder was stretched to obtain a hollow fiber having an outer diameter of 160 $\mu$m and an inner diameter of 80 $\mu$m.

After this, a bundle of the hollow fibers obtained were placed in a chamber and the chamber was evacuated. Then, a liquid, in which the spherical display elements obtained as mentioned above were dispersed, was introduced into the chamber so that the liquid was drawn into and filled the inside of the hollow fiber. In this embodiment, a two-liquid system including Isoper-G (a product of Exxon Chemical Co.) and PF5052 (a product of Sumitomo 3M Ltd.) was used as the liquid for dispersing the display elements.

Then, the hollow fibers containing the display elements and the liquid were cut so that the length thereof became about 3 mm by using a cutter whose cutting edge was heated. The end portions of the hollow fibers were sealed when cut because of the heat at the cutting edge of the cutter which melted and plugged the cut portions of the hollow fibers. In this manner, display units including hollow tube members containing the display elements inside thereof were obtained.

The display units obtained were formed into a substantially uniform web (matrix) and subjected to a needling process onto a foundation cloth made of filament yarn of nylon 66. In this manner, a sheet type display unit having a width of about 500 $\mu$m was prepared.

After this, the above-mentioned sheet of the display unit was sandwiched by transparent electrodes in the up-and-down direction to produce a display device. The electrode plates were made of glass, and one surface thereof was vapor deposited with ITO. When a positive charge was given to the upper electrode and a negative charge was given to the lower electrode by using a direct current power source and the voltage difference between the electrodes was set to be 200 V, the display elements showed their white surfaces to the upper electrode (i.e., towards the display surface). When the positions of the electrodes were reversed, the display elements showed their black surfaces to the display surface. The optical image concentration of the display surface was measured by using a Macbeth densitometer, and the ratio of image concentration when the black face was displayed with respect to when the white face was displayed was measured as a contrast ratio.

Embodiment 2

Display elements of cylindrical shape were prepared by using a nylon fiber. That is, a heat resistant acrylic adhesive was applied onto a surface of a medium made of a polyester film having a width of about 10 cm to form an acrylic adhesive layer having a width of 35 $\mu$m thereof. A fishing line made of nylon (Fighter No. 0.2 having a width of about 70 $\mu$m, a product of Yamatoyo Tegusu Co.) was cut to be about 9 cm in length, and the nylon line pieces were placed on the adhesive layer so as to be arranged in a monolayer. After a sufficient amount of the nylon line pieces were placed on the adhesive layer of the medium, the nylon line pieces were compressed onto the adhesive layer so that the half of each piece was embedded in the adhesive layer, by using a silicone rubber roller via a sheet made of polytetrafluoroethylene having a width of about 50 $\mu$m. After this, the nylon line pieces which were raised from the surface were removed by hand to arrange the monolayer of the nylon line pieces on the medium. The thickness of the adhesive layer was preset to be about 35 $\mu$m so that almost the half of the nylon line pieces may be embedded in the adhesive layer.

Then, the surface of the medium into which the nylon line pieces were embedded was painted black by using a push-refresh type white board marker (a product of Pentel Co.) The hemisphere portions of the nylon line pieces which were painted black had a state of surface charge distribution different from that of the other hemisphere portion which was not painted.

After this, the medium was immersed in ethanol from the surface opposite the surface in which the nylon line pieces were embedded, and the nylon line pieces were separated from the adhesive layer while the adhesive layer was dissolved in ethanol. The hemisphere portions of the nylon line pieces which had been embedded in the adhesive layer were not painted whereas the other hemisphere portions exposed were colored black. The nylon line pieces were further cut by using a cutter so that the length of the cut pieces became about 1 mm. In this manner, a number of display elements of cylindrical shape was obtained.

Finally, a display device was prepared in the same manner as described in Embodiment 1 and the contrast ratio was measured by using the same condition as in Embodiment 1.

The results showed that the contrast ratio of the display devices prepared in Embodiments 1 and 2 were in the range between about 4:1 and 6:1, which was the same level as the printing quality of a newspaper.

As explained above, according to the present invention, a display device of a light receiving type device may be easily produced which is capable of forming an image that is kind to the eye in a manner like that of printed matter, and does not cause eyestrain due to flickering of emitted light. Also, according to the present invention, since a display medium which is capable of accurately reproducing an image information is obtained, a significant contribution may be made to industry.

Having thus described example embodiments of the invention, it will be apparent that various alterations, modifications, and improvements will readily occur to those skilled in the art. Such alterations, modifications, and improvements, though not expressly described above, are nonetheless intended and implied to be within the spirit and scope of the invention. Accordingly, the foregoing discussion is intended to be illustrative only; the invention is limited and defined only by the following claims and equivalents thereto.

What is claimed is:

1. A display unit, comprising:

a transparent hollow tube member; and at least one display element sealed in said transparent hollow tube member, said at least one display element positioned substantially co-axial with said transparent hollow tube member and capable of rotating independently therein, wherein said display element has a surface which is divided into a plurality of areas having different colors, and said display element is polarized to have at least two poles having a different electrification state;

wherein a plurality of said display units are arranged over substantially the entire display region of a display device.

2. A display unit as set forth in claim 1, wherein the shape of said display element is selected from the group consisting of a sphere, oval, and cylinder.

3. A display unit as set forth in claim 1, further comprising:

a liquid which is sealed in said hollow tube member, said liquid being present between said display element and said hollow tube member.

4. A display device including at least one display unit comprising:

a transparent hollow tube member; and at least one display element sealed in said transparent hollow tube member, said display element being capable of rotating independently, wherein said display element has a surface which is divided into a plurality of areas having different colors, said display element is polarized to have at least two poles having a different electrification state and a plurality of said display units is arranged over substantially the entire display region of said display device and substantially all of said plurality of display units are arranged so as to be substantially parallel to each other.

5. A display device as set forth in claim 4, further comprising:

an electric field application device which applies an electric field to said display unit.

6. A method for displaying colors on a display by using a display device as claimed in claim 5, comprising the step of:

applying an electric field corresponding to an image signal to said display element.

7. A method for producing a display device comprising the steps of:

forming a hollow tube member;

introducing a liquid into said hollow tube member;

inserting at least one display element into said liquid in said hollow tube member, said at least one display element positioned substantially co-axial with said hollow tube member;

sealing an end portion of said hollow tube member to form a display unit comprising said hollow tube member and said at least one display element; and arranging said display unit over a display region of said display device;

wherein a plurality of said display units are arranged over substantially the entire display region of said display device.

8. A method for producing a display device as set forth in claim 7, wherein the specific gravity of said liquid is close to the specific gravity of said display element.

9. A method for producing a display device as set forth in claim 7, wherein said liquid is of a two-liquid system formed by combining a first liquid having higher specific gravity than that of said display element and a second liquid having lower specific gravity than that of said display element.

10. A method for producing a display device as set forth in claim 7, wherein said hollow tube member is formed by a method comprising the steps of:

forming a fiber having a two-layer structure; and removing an inner layer of said fiber to produce said hollow tube member.

11. A method for producing a display device as set forth in claim 10, wherein said inner layer of said fiber is made of a material which may be dissolved in a solvent.

12. A method for producing a display device including at least one display unit, comprising the steps of:

forming a fiber having a three-layer structure including an outermost layer, an innermost layer, and an intermediate layer, said intermediate layer formed generally between, and co-axially with, said outermost layer and said innermost layer;

dissolving said intermediate layer of said fiber;

sealing an end portion of said fiber to form a display unit comprising said innermost layer of said fiber freely rotatable in said outermost layer of said fiber; and arranging a plurality of said display units over substantially the entire display region of a display region of said display device, wherein said innermost layer of said fiber functions as a display element and said outermost layer of said fiber functions as a hollow tube member.

13. A method for producing a display device as set forth in claim 12 wherein said intermediate layer is dissolved by a solvent or by an irradiation of light.

14. A method for producing a display device as set forth in claim 12 wherein the specific gravity of said intermediate layer, after being dissolved, is substantially the same as the specific gravity of said display element.

15. A method for producing a display device as set forth in claim 12 wherein said display element of said display unit is cut by using a laser beam, a rotary knife, or a straight knife.

* * * * *